US006386249B1

(12) United States Patent
Murphy

(10) Patent No.: US 6,386,249 B1
(45) Date of Patent: May 14, 2002

(54) AFFORDABLE FIREWOOD SPLITTING KIT

(76) Inventor: Milford R. Murphy, 1101 Lynda La., Arlington, TX (US) 76013

( * ) Notice: Subject to any disclaimer, the term of this patent is extended or adjusted under 35 U.S.C. 154(b) by 0 days.

(21) Appl. No.: 09/498,138

(22) Filed: Feb. 4, 2000

(51) Int. Cl.[7] ..... B27L 7/00
(52) U.S. Cl. ..... 144/95.1; 144/193.1; 144/366
(58) Field of Search ..... 144/193.1, 195.1, 144/366; 254/104, 93.4

(56) References Cited

U.S. PATENT DOCUMENTS 4,275,778 A * 6/1981 Kotas ..... 144/195.1
4,331,192 A * 5/1982 Hung ..... 144/195.1

OTHER PUBLICATIONS

MVP Industries, Inc, "Brand New Trolley Wood Splitter", Oct. 1979.*
The Washington Post, Des A "Portable Hydraulic Log Splitter", Sep. 1979.*

* cited by examiner

*Primary Examiner*—W Donald Bray

(57) ABSTRACT

The invention is a man-portable firewood splitter and is affordable for personal use. It uses an off-the-shelf hydraulic car jack, an off-the-shelf firewood splitting wedge, and a platform that is configured so that it combines the other two units to provide a firewood splitting function. The components are physically unattached and can be used for other requirements. The platform is somewhat like to a bed with side rails. It consists of two end plates, a bottom, and two side rails. It is structured to withstand the maximum force of the hydraulic jack. To assemble the system, the jack is horizontally placed on the bottom of the platform with the jack base butted against one of the end plates and oriented so that the jack handle is vertical. The blunt end of the splitting wedge is horizontally placed against the ram of the jack. The firewood to be split is horizontally placed on the bottom of the platform with one end against the other platform end plate, and, hence, the other end will be exposed to the blade end of the wedge. Blocks of wood are placed under the jack and the Wedge to elevate them to the desired height For splitting firewood. The stick of firewood is split by moving the jack handle for and aft which drives the wedge into the wood. The jack has a nominal stroke of 5 inches. If a longer stroke is needed, the ram can be reset and the jackscrew extended.

5 Claims, 5 Drawing Sheets

AFFORDABLE FIREWOOD SPLITTING KIT

BACKGROUND OF INVENTION

1. Classification Definitions

The present invention relates to a man-portable firewood splitting kit that uses three major components: two off-the-shelf components and one manufactured component. It was especially conceived to provide an affordable firewood splitter for personal use.

2. Prior Art

To the best of the inventor's knowledge, the firewood splitters on the current market are for commercial use. The current cost of these units run from $1,000 to over $2,000 which is very costly if procured for personal use. Also, the commercial units are comparatively very large and are normally mounted on a trailer-like vehicle and towed behind a car/truck. A typical commercial wood splitter consists of a gasoline (or electric) motor which drives a hydraulic pump that provides the hydraulic power for the operation of a hydraulic actuator, which, in turn, drives a heavy duty splitting blade.

As expected, the commercial splitter will split firewood at a faster rate than the present invention but, judged on the above comparison, it is difficult to justify the commercial units for personal use.

BRIEF SUMMARY OF THE INVENTION

The objective of this invention is to provide an affordable, man-portable firewood splitting kit for persons that own or have access to wooded areas; e.g., farms, ranches, recreational areas, etc. To accomplish this objective, this invention uses a platform configured to operate, in combination with an off-the-shelf hydraulic car/truck jack and an off-the-shelf wood splitting wedge to effect a firewood splitting function. All components are physically unattached. Blocks of wood are used to set the jack and wedge at the desired level for operation. Firewood splitting is accomplished by first horizontally placing the jack on the platform with the base against one end plate of the platform. The jack is oriented so that the jack handle is vertical. A stick of firewood is then horizontally placed with one end butted against the other end plate of the platform. The splitting wedge is then placed on the platform between the jack and the wood with the cutting edge against the wood. Operation of the jack handle in a conventional fore and aft motion drives the jack ram which, in turn, drives the wedge into the wood to affect the wood splitting function.

BRIEF DESCRIPTION OF PHOTOGRAPHIC VIEWS OF THE EQUIPMENT

The file of this patent contains photographs executed in color. Copies of this patent with color photographs will be provided by the Patent and Trademark Office upon request and payment of the necessary fee. The photographs, as identified below, have been included to support the Detailed Description of the Invention section.

Figure 3:
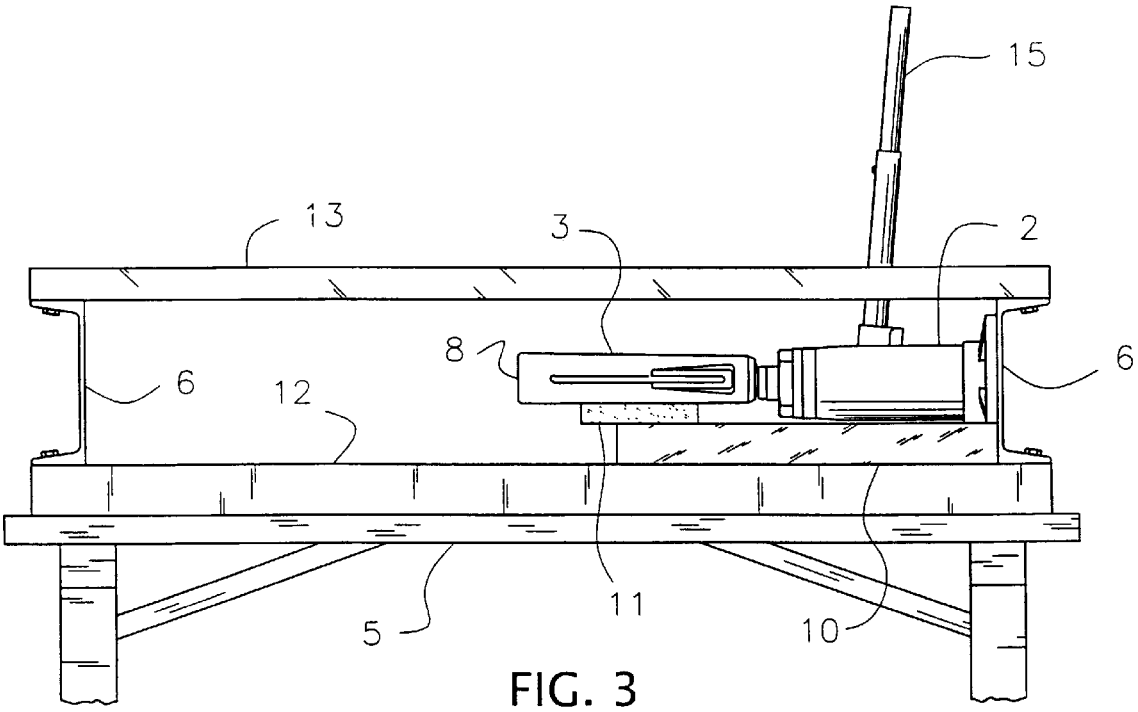

FIG. 3 is a view of the kit from the side. It should be noted that a block of wood is used under the jack to raise it to a desired level for splitting wood. Also, a second block is shown under the wedge to raise it to the level of the jack ram.

Figure 4:
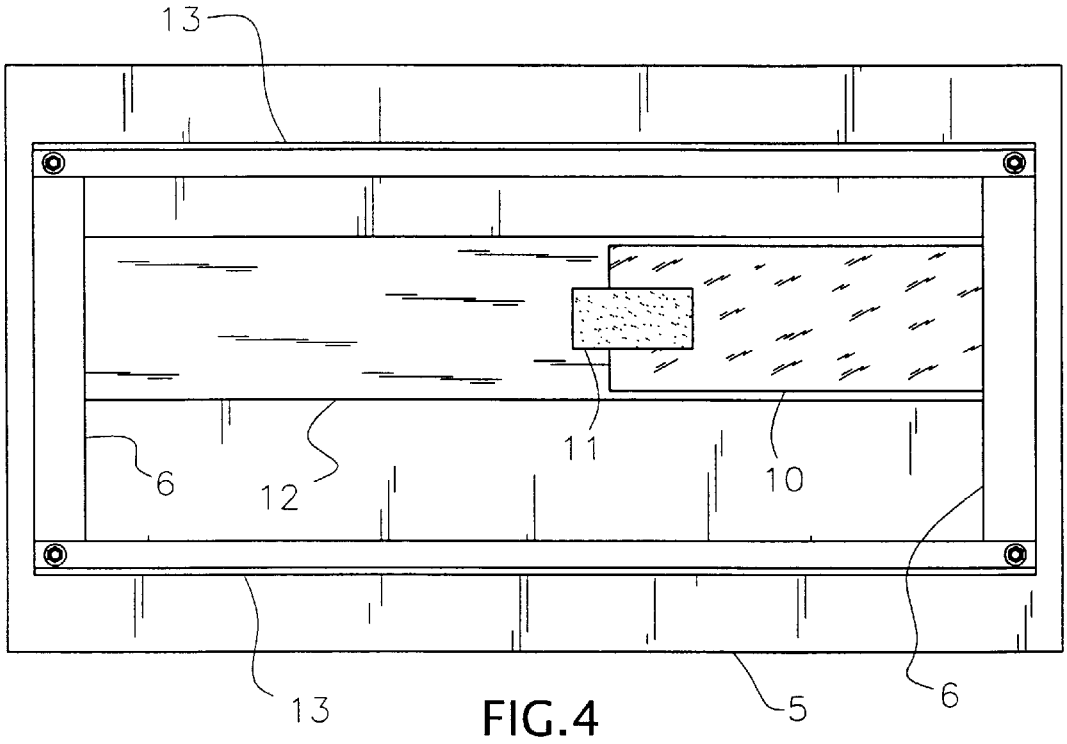

FIG. 4 is a top view of the platform and blocks.

Figure 5:
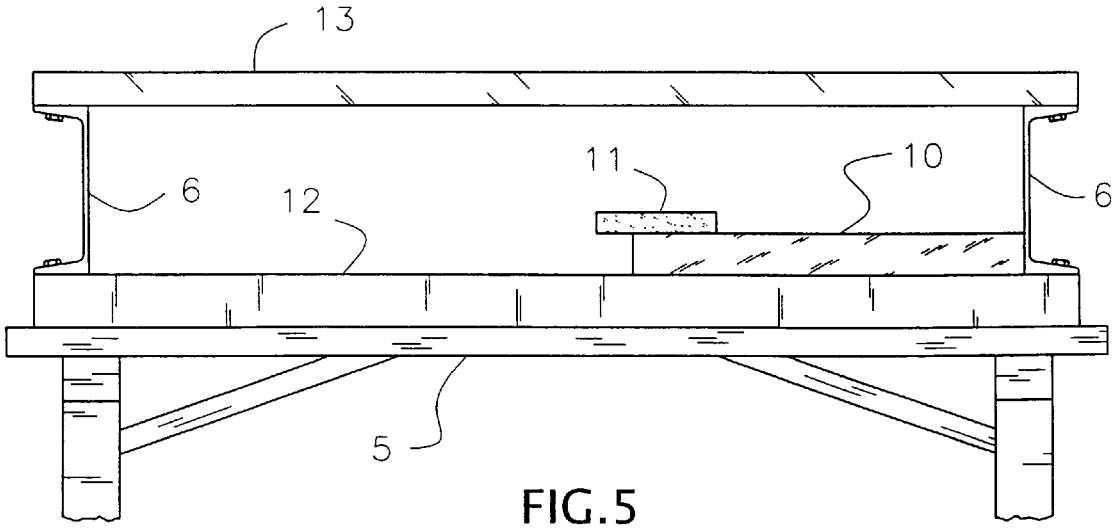

FIG. 5 is a side view of the platform and blocks.

Figure 6:
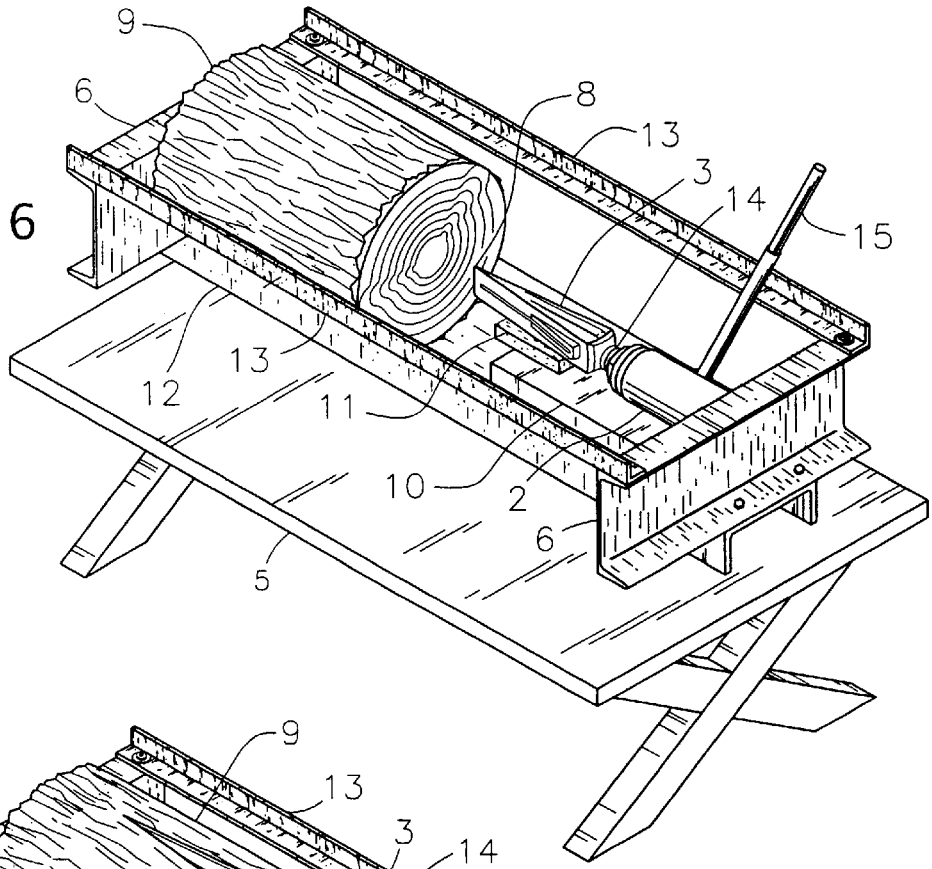

FIG. 6 is a view showing a stick of firewood properly placed for splitting.

Figure 7:
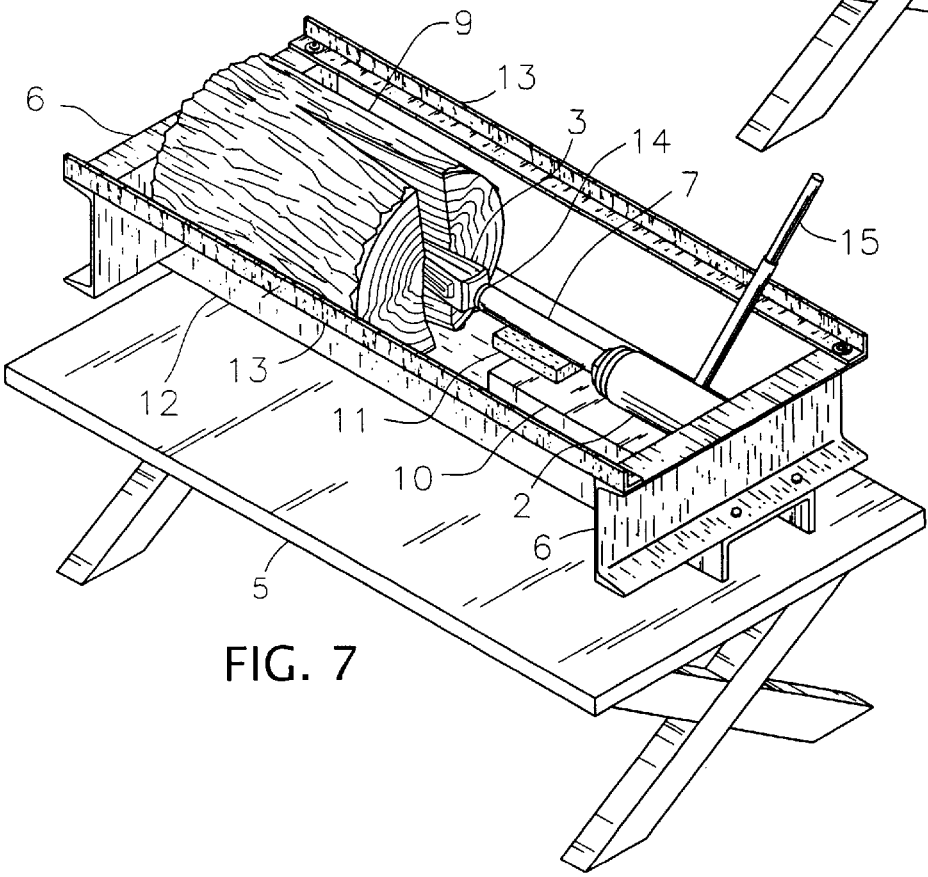

FIG. 7 shows an 11 ½" diameter stick of mesquite being split.

Figure 8:
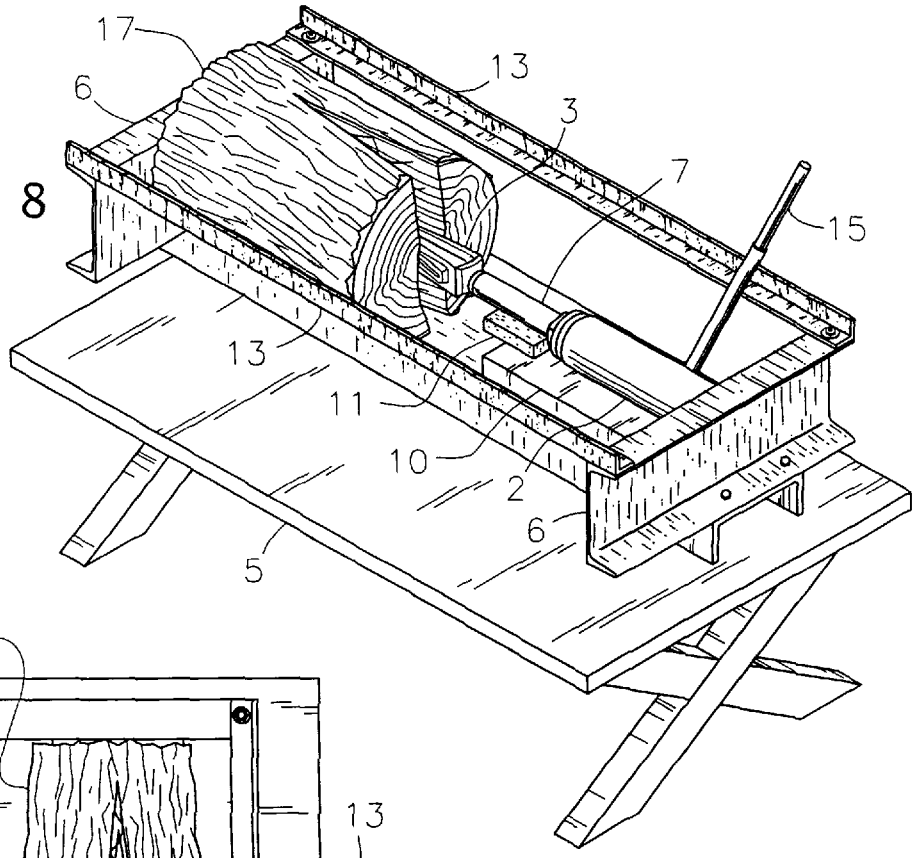

FIG. 8 shows an 8" diameter stick of green post oak being split.

Figure 9:
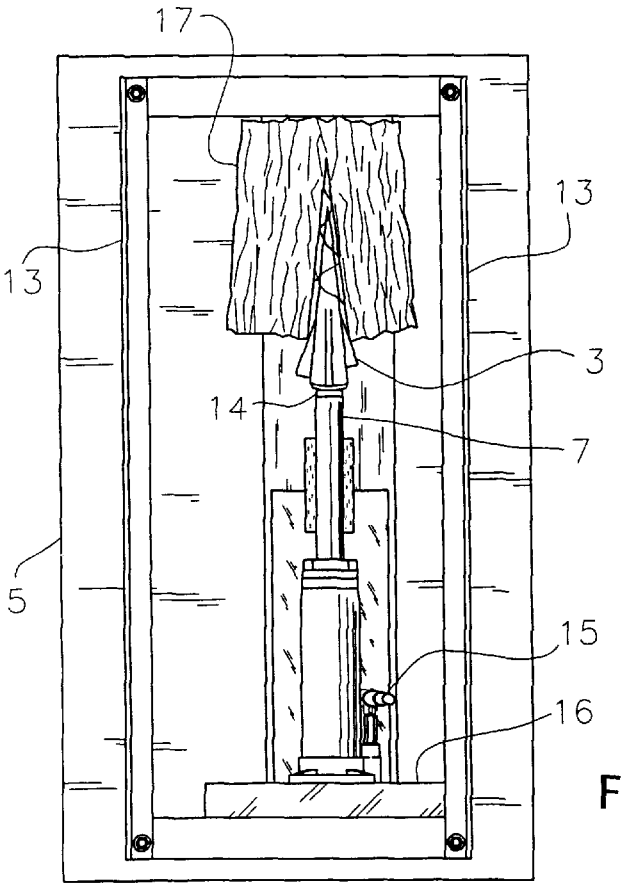

FIG. 9 shows the post oak after a reset of the ram was required. Note the strands holding the two halves together which is common for unseasoned wood.

DETAILED DESCRIPTION OF THE INVENTION

Figure 1:
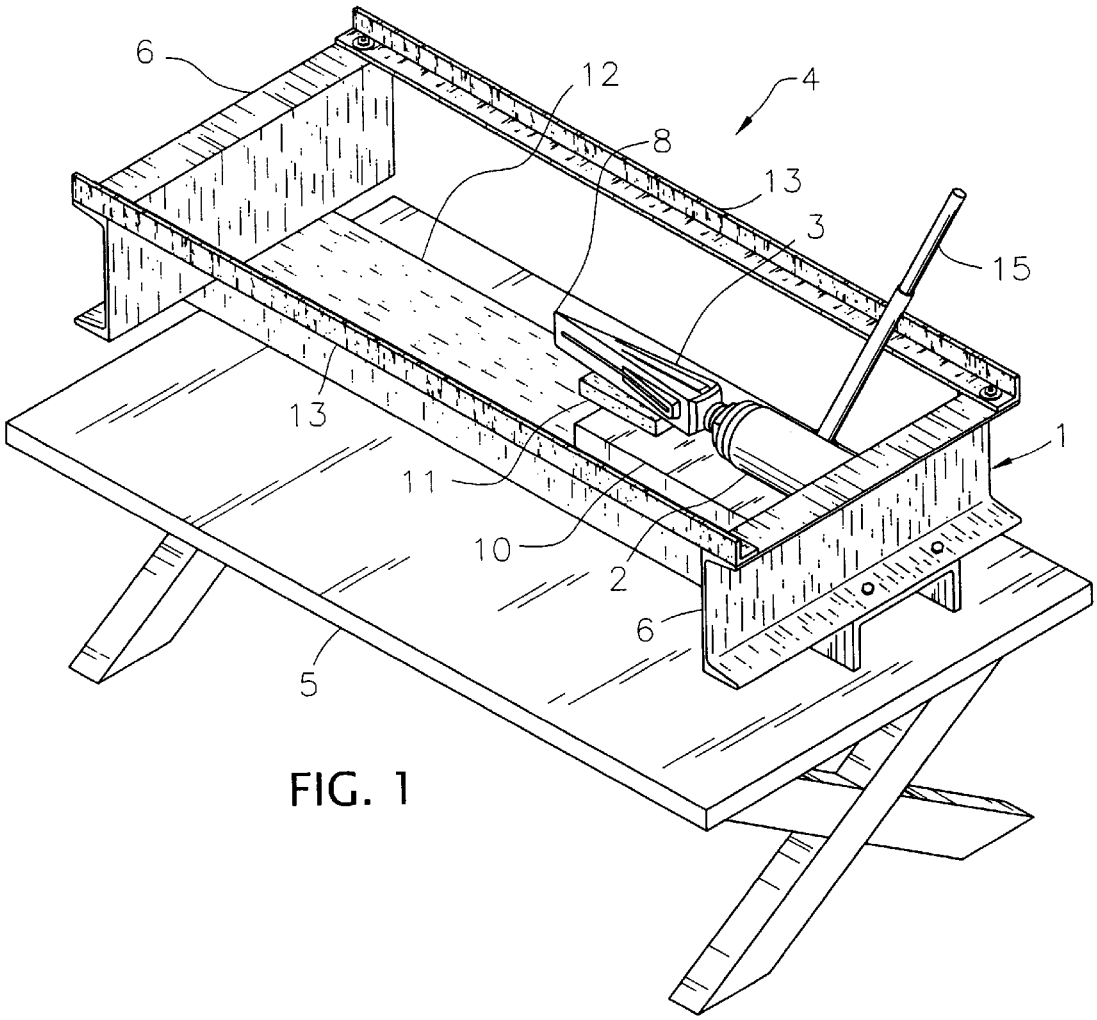
FIG. 1 is a perspective view of the concept/test model of the kit with the components in place for operation.
Figure 2:
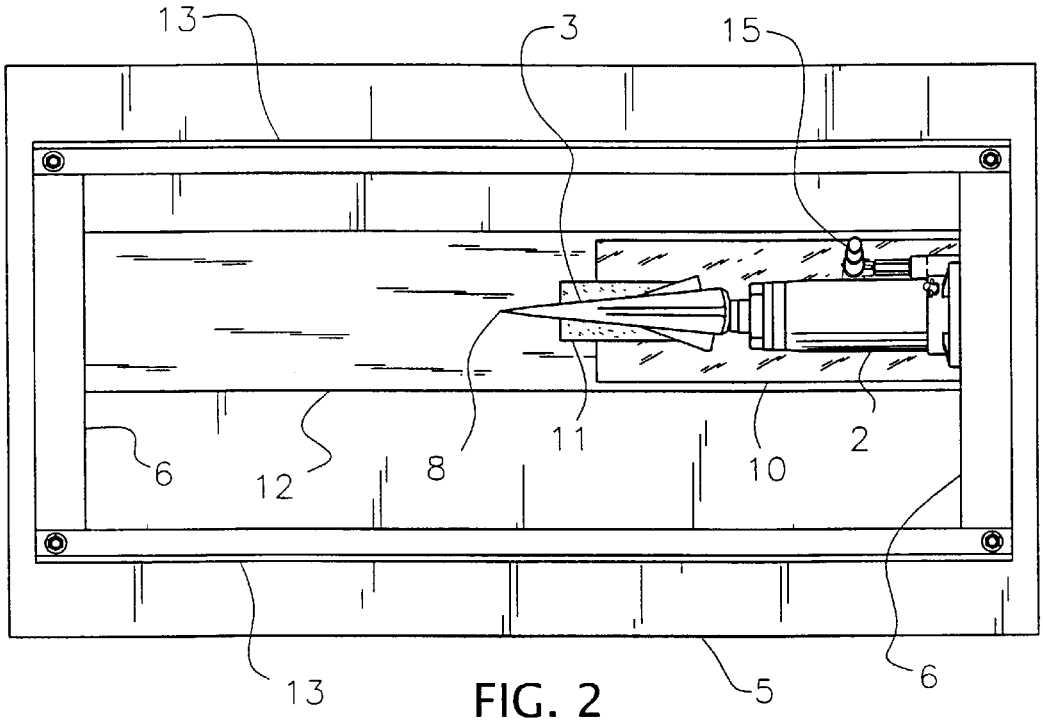
FIG. 2 is a top view of this kit.

The objective of this invention is to provide an affordable personal firewood splitting device for persons that own or have access to wooded areas; e.g., farms, ranches, recreational areas, etc. To accomplish this objective, a concept was developed using a platform 1 configured to operate in conjunction with an off-the-shelf hydraulic car/truck jack 2 and an off-the-shelf wood splitting wedge 3 to effect a firewood splitting function. A proof of concept model 4 of the invention is shown in FIGS. 1, 2, and 3. The concept model 4 has been tested on woods that are native to the central Texas area, e.g., live oak, mesquite, post oak, etc. The splitter, as shown in all of the figures, is displayed on an available redwood bench 5. As shown in FIGS. 1, 2, and 3, the hydraulic jack 2 is placed horizontally (unattached) within the platform 1 with the base against one end plate 6 of the platform 1. The jack 2 is oriented so the handle is vertical. The splitting wedge 3 is horizontally placed (unattached) within the platform 1 with the blunt end against the jack ram 7 so that the blade end 8 can be driven by the ram 7 into the wood 9. Blocks of wood 10 and 11 are used to set the jack 2 and the wedge 3 at a desired level to accommodate the diameter of the wood 9 being split. The black block 10, shown in the photographs, is two inches thick and is suitable for most wood diameters. The light colored block 11 is used to raise the level of the wedge 3 to the proper level for the hydraulic ram 7. The major equipment, the operation of the system, and the test of the concept model 4 are described in more detail in the remainder of this section.

Equipment

Platform—The concept model 4 of the platform 1, along with the leveling blocks 10 and 11, is shown in FIGS. 4 and 5. As shown in FIGS. 1, 2, and 3, the platform 1 houses the jack 2 and wedge 3. The wood 9 to be split is placed between the blade 8 of the wedge 3 and the end plate 6 of the platform. The platform was structured to withstand the maximum force of the jack 2.

The base 12 of the platform 1 and the end plates 6 used in the concept model 4 are made from 6"×2"×¼" channel iron. The base 12 is 36" in length and the end plates 6 are 12" in length. The angle iron used for the side braces 13 is 1 ½"×1 ½"×⅛". The requirements for the platform 1 could have been achieved using other approaches. For example, in place of the side rails 13, the end plates 6 could have been braced on the rear or front side to the bottom plate 12. Another approach would be to replace the side rails 13 with cables since only tension forces are required. Also, rods could be used in place of the angle iron side rails 13.

Hydraulic Jack—The jack 2 in the concept model 4 is an off-the-shelf car jack 2 that can be purchased at most hardware/automotive supply stores. Several good brands are available. The one used in the concept model 4 is a six-ton jack and has a stroke of about five inches with the capability of using the ram jackscrew 14 feature to extend the effective stroke to nine inches. A jack 2 with a longer stroke could be used with an increase in platform length to accommodate the extra stroke. It is pointed out that the jack 2 is not attached to the platform 1 and is available for other needs; e.g. jacking up a car or tractor.

Wood Splitting Wedge—The wedge 3 is a conventional wood splitting wedge that can be purchased from most hardware/.department stores. It also can be used for other purposes since it is not attached to the platform 1.

Operation

The operation is simple and straightforward. The system is prepared for wood splitting by placing the jack 2 on blocks 10 and 11 as shown in FIGS. 2 and 3. The black block 10 is two inches thick and is suitable for most diameter wood. The stick of wood 9 in FIG. 6 is about 11 ½ inches in diameter. If for some reason a stick of a smaller diameter of wood (e.g., three inches) is required to be split, the two inch black block 10 can be removed. The small light colored block 11 would still be used since it is needed to raise the wedge 3 to the level of the jack ram 7.

To perform the splitting operation, place a stick of firewood 9 on the platform 1 as shown in FIG. 6. The jack ram 7 has a jack screw 14 feature so that the ram 7 head can be adjusted so that the cutting edge 8 of the wedge 3 is against the wood 9 as shown in FIG. 6. For best operation, the cutting edge 8 of the wedge 3 should be approximately on a radial from the center of the wood. The wood splitting operation is performed simply by fore and aft motion of the jack handle 15 in a manner like jacking up a car. FIG. 7 is a photograph of the wood 9 being split. If for some reason the five-inch stroke does not completely split the wood 9, the ram 7 can be reset and the jackscrew 14 can be extended to effect a longer stroke. Another approach would be to, reset the ram 7 and to place a short 4"×4" block of wood 16 between the base of the jack 2 and end plate 6 of the platform 1 as shown in FIG. 9.

Tests

The concept model 4 has been tested on live oak, mesquite, and post oak. Live oak is the most dense and, hence, is the hardest to split. Mesquite is normally the easiest to split. The most commonly used firewood is 8 to 10 inch post oak because of its availability. It is comparatively easy to split. All firewood should be seasoned to ease the splitting process. Seasoned firewood that is eight inches or larger in diameter may require the ram 7 to be reset; it depends on how straight the grain is. The five-inch ram 7 stroke is usually adequate for smaller diameter firewood.

FIGS. 7, 8, and 9 show examples of the splitting process. FIG. 7 shows an 11 ½-inch diameter stick of mesquite firewood 9 being split After the initial five-inch ram stroke, the stick of firewood 9 could have probably been pulled apart or would have come apart if dropped on the ground. However, it is easy to reset the ram 7, place a short 4'×4" block or wood 16 behind the base of the jack 2 (see FIG. 9) and drive the wedge 3 another five inches to complete the split.

FIG. 8 shows an 8 ½" stick of green post oak being split. This specimen required the ram 7 to be reset so that the wedge 3 could be driven an additional five inches as shown in FIG. 9. Green wood 17 is much harder to split primarily because of the strands of wood that tend to hold the two halves together. FIG. 9 is a close-up showing the strands attached to each side of the split.

What is claimed is:

1. A lightweight portable log splitting kit comprising: physically unattached components including a platform consisting of an elongated base having first and second ends with first and second end plates connected to said first and second ends of the base; and, first and second side braces connecting a top outside of the said first and second end plates; a hydraulic actuator having a ram extending therefrom, said hydraulic actuator having a bottom thereof supported by the said first end of the base and butted against the first said end plate; a splitting wedge with a hammer end butted against the ram of the hydraulic actuator and a cutting edge butted against a log which is supported by the base and butted against the said second end plate; a first height adjusting block for the actuator, and a second height adjusting block for adjusting the height of the wedge relative to the actuator.

2. The apparatus of claim 1 wherein the actuator is a commercially available hydraulic car jack which consists of a square bottom plate, hydraulic fluid reservoir, cylinder, piston/ram, control valve, and a handle to operate the valve which controls the flow of hydraulic fluid into the cylinder which, in turn, drives the piston and ram; wherein the actuator can be positioned within the platform to best accommodate each splitting condition.

3. The apparatus of claim 1 wherein the splitting wedge is a commercially available firewood splitting wedge which is a solid metal wedge shaped tool having a first and second end, wherein the said first end is comparatively flat and butted against the actuator ram while the said second end is blade shaped and butted against the log to be split; whereby the spitting wedge can be rotated as required for each splitting condition.

4. The apparatus of claim 1 wherein the said first block for adjusting the height of the actuator is positioned between the base and the actuator and butted against the first end plate thereby raising the vertical position of the said actuator to a level that will accommodate differing firewood diameters.

5. The apparatus of claim 1 wherein the said second block for adjusting the height of the splitting wedge is positioned between the said first block for supporting the actuator and the splitting wedge, whereby the splitting wedge can be raised to the same level as the actuator ram.

* * * * *